US009524669B2

(12) United States Patent
Sato

(10) Patent No.: US 9,524,669 B2
(45) Date of Patent: Dec. 20, 2016

(54) LIGHT-EMITTING ELEMENT DISPLAY DEVICE

(71) Applicant: Japan Display Inc., Tokyo (JP)

(72) Inventor: Toshihiro Sato, Tokyo (JP)

(73) Assignee: Japan Display Inc., Tokyo (JP)

( * ) Notice: Subject to any disclaimer, the term of this patent is extended or adjusted under 35 U.S.C. 154(b) by 7 days.

(21) Appl. No.: 14/339,494

(22) Filed: Jul. 24, 2014

(65) Prior Publication Data

US 2015/0029235 A1 Jan. 29, 2015

(30) Foreign Application Priority Data

Jul. 26, 2013 (JP) ..... 2013-155375

(51) Int. Cl.
*G09G 3/3233* (2016.01)
*G09G 3/32* (2016.01)

(52) U.S. Cl.
CPC .... *G09G 3/3233* (2013.01); *G09G 2300/0452* (2013.01); *G09G 2340/06* (2013.01); *G09G 2360/16* (2013.01)

(58) Field of Classification Search
CPC ..... G09G 2300/0439; G09G 2300/0443; G09G 2300/0452; G09G 3/3225; G09G 2320/0233; G09G 2320/0626–2320/0653
See application file for complete search history.

(56) References Cited

U.S. PATENT DOCUMENTS 5,642,176 A * 6/1997 Abukawa et al. G02F 1/133514 349/106
6,771,028 B1 * 8/2004 Winters ..... G09G 3/3233 315/169.1
6,919,681 B2 * 7/2005 Cok et al. ..... G09G 3/3216 313/500
8,552,944 B2 * 10/2013 Pei et al. ..... G09G 3/3685 345/87
8,836,736 B2 * 9/2014 Mammen et al. G02F 1/133606 345/690
2004/0108978 A1 * 6/2004 Matsueda et al. ... G09G 3/3233 345/76
2004/0149886 A1 * 8/2004 Matsueda et al. ... G09G 3/3233 250/208.1
2004/0217694 A1 * 11/2004 Cok et al. ..... G09G 3/3216 313/504

(Continued)

FOREIGN PATENT DOCUMENTS

JP 2007-531062 11/2007
JP 2007-531082 A 11/2007

*Primary Examiner* — Patrick F Marinelli
(74) *Attorney, Agent, or Firm* — Typha IP LLC

(57) ABSTRACT

A light-emitting element display device includes a light-emitting element display panel that displays an image by light emission of light-emitting regions of a plurality of sub-pixels. Each of the pixels includes a first R sub-pixel, a second R sub-pixel, a first G sub-pixel, a second G sub-pixel, a first B sub-pixel and a second B sub-pixel. The second R sub-pixel, the second G sub-pixel, and the second B sub-pixel include a W electrode as a common electrode that causes the second R sub-pixel, the second G sub-pixel, and the second B sub-pixel to simultaneously emit lights in response to the application of a potential. The driver circuit includes a sub-pixel control unit that calculates a peak luminance in a screen based on the video signal and controls the plurality of sub-pixels based on the peak luminance.

7 Claims, 9 Drawing Sheets

(56) References Cited

U.S. PATENT DOCUMENTS

2004/0222746 A1* 11/2004 Winters ..... G09G 3/3233 315/167
2004/0233141 A1* 11/2004 Matsumoto ..... G09G 3/3266 345/76
2005/0030048 A1* 2/2005 Bolender et al. ..... G06F 3/0202 324/661
2005/0212728 A1 9/2005 Miller et al.
2005/0248594 A1* 11/2005 Usui et al. ..... G09G 3/2007 345/690
2005/0275610 A1* 12/2005 Roh et al. ..... G09G 3/3614 345/88
2006/0267892 A1* 11/2006 Pei et al. ..... G09G 3/3685 345/88
2008/0272987 A1* 11/2008 Lee et al. ..... G02F 1/167 345/55
2008/0290807 A1* 11/2008 Matsueda et al. ... G09G 3/3233 315/169.3
2009/0128694 A1* 5/2009 Yang et al. ..... G09G 3/2003 348/453
2010/0053038 A1* 3/2010 Sakamoto ..... H01L 51/5265 345/76
2010/0053043 A1* 3/2010 Sakamoto ..... H01L 27/3213 345/77
2010/0097413 A1* 4/2010 Matsumoto ..... G09G 3/2944 345/691
2010/0156966 A1* 6/2010 Kageyama et al. . G09G 3/3233 345/691
2010/0225574 A1* 9/2010 Fujiwara et al. .... G09G 3/3426 345/102
2010/0253664 A1* 10/2010 Byun et al. ..... G09G 3/3208 345/211
2010/0289884 A1* 11/2010 Kang ..... G02B 27/2228 348/58
2011/0102412 A1* 5/2011 Yamamoto et al. . G09G 3/2092 345/212
2011/0234646 A1* 9/2011 Han et al. ..... G09G 3/3208 345/690
2011/0267327 A1* 11/2011 Hwang ..... G09G 3/3208 345/211
2012/0139885 A1* 6/2012 Iwasa et al. ..... G09G 3/3426 345/207
2013/0141481 A1* 6/2013 Peng et al. ..... G02F 1/134309 345/694
2013/0207940 A1* 8/2013 Song et al. ..... G09G 3/20 345/204
2014/0152721 A1* 6/2014 Byun et al. ..... G09G 3/3291 345/691
2014/0204321 A1* 7/2014 Koh et al. ..... G02F 1/133514 349/109
2014/0313110 A1* 10/2014 Ito et al. ..... G09G 3/3233 345/77
2014/0354520 A1* 12/2014 Sato et al. ..... G09G 3/3233 345/77
2014/0369072 A1* 12/2014 Liao et al. ..... G02B 6/0068 362/613
2015/0029235 A1* 1/2015 Sato ..... G09G 3/3233 345/690
2015/0116375 A1* 4/2015 Yang et al. ..... G09G 3/2003 345/690

* cited by examiner

LIGHT-EMITTING ELEMENT DISPLAY DEVICE

CROSS-REFERENCE TO RELATED APPLICATION

The present application claims priority from Japanese application JP2013-155375 filed on Jul. 26, 2013, the content of which is hereby incorporated by reference into this application.

BACKGROUND OF THE INVENTION

1. Field of the Invention

The present invention relates to a light-emitting element display device, and more particularly to a light-emitting element display device that performs display by causing a light-emitting element as a self-luminous body arranged in each of pixels to emit light.

2. Description of the Related Art

In recent years, an image display device (hereinafter referred to as an "organic EL (Electro-luminescent) display device") using a self-luminous body called an organic light-emitting diode (OLED) has been put to practical use. Since the self-luminous body is used, the organic EL display device is superior in terms of visibility and response speed compared to a related-art liquid crystal display device, and in addition, a further reduction in thickness is possible in the organic EL display device because an auxiliary lighting device such as a backlight is not necessary.

For color display in such an organic EL display device, mainly, the organic EL display device includes light-emitting elements that respectively emit lights of three colors of R (red), G (green), and B (blue) in respective pixels in some cases, while, in other cases, the organic EL display device causes a light-emitting element to emit only white light and allows the light to transmit respective wavelength ranges of three colors of R, G, and B through color filters of respective pixels. Moreover, for increasing a contrast ratio without increasing power consumption in the liquid crystal display device, it has been known to further provide a W (white) pixel in addition to R, G, and B pixels to increase luminance.

JP 2007-531062 A discloses a display device including a light-emitting layer that emits Y (yellow) light in addition to light-emitting layers that respectively emit R, G, and B lights.

SUMMARY OF THE INVENTION

Also in the light-emitting element display device including light-emitting elements that individually emit lights of respective colors of R, G, and B, it is desired for expanding a color reproduction range and improving color purity to further add a light-emitting element of W, Y or the like to the R, G, and B light-emitting elements to have four colors. However, such a configuration increases the number of times of deposition process, which is not favorable from the viewpoint of manufacturing cost. Moreover, since the accuracy of a deposition process is rougher than the accuracy of a photolithography process, an increase in the number of times of deposition process leads to an obstruction in higher definition or a deterioration in aperture ratio.

The invention has been made in view of the circumstances described above, and it is an object of the invention to provide a light-emitting element display device whose manufacturing cost is suppressed and that has an expanded color reproduction range and improved color purity.

A light-emitting element display device according to an aspect of the invention includes: a light-emitting element display panel that displays an image by light emission of light-emitting regions of a plurality of sub-pixels arranged in each of pixels in a display region, controlled by a driver circuit, wherein each of the pixels includes a first R (red) sub-pixel and a second R sub-pixel each of which emits light in a red wavelength range, a first G (green) sub-pixel and a second G sub-pixel each of which emits light in a green wavelength range, and a first B (blue) sub-pixel and a second B sub-pixel each of which emits light in a blue wavelength range, the first R sub-pixel, the first G sub-pixel, and the first B sub-pixel respectively include an R electrode, a G electrode, and a B electrode that control light emission independently of one another in response to the application of potentials, the second R sub-pixel, the second G sub-pixel, and the second B sub-pixel include a W (white) electrode as a common electrode that causes the second R sub-pixel, the second G sub-pixel, and the second B sub-pixel to simultaneously emit lights in response to the application of a potential, and the driver circuit includes a sub-pixel control unit that acquires a video signal to calculate a peak luminance in a screen based on the video signal and controls the plurality of sub-pixels based on the peak luminance.

In the light-emitting element display device according to the aspect of the invention, the sub-pixel control unit may include a peak luminance calculating unit that calculates the peak luminance, an area luminance determining unit that determines, based on the peak luminance calculated by the peak luminance calculating unit, the luminance of a W sub-pixel including the W electrode arranged in the pixel in each of areas obtained by dividing the display region into a plurality of regions, and a W sub-pixel control unit that applies, using the luminance of the W sub-pixel, a potential to the W electrode arranged in the pixel in each of the areas.

In the light-emitting element display device according to the aspect of the invention, the area luminance determining unit may further determine a light emission time period as a time period in which the potential is applied.

In the light-emitting element display device according to the aspect of the invention, the area luminance determining unit may further determine the division of areas based on the peak luminance.

In the light-emitting element display device according to the aspect of the invention, the sub-pixel control unit may further include an RGB sub-pixel control unit that determines, based on determination of the area luminance determining unit, the luminances of the first R sub-pixel, the first G sub-pixel, and the first B sub-pixel and applies, based on the respective determined luminances, potentials to the R electrode, the G electrode, and the B electrode.

In the light-emitting element display device according to the aspect of the invention, a scanning signal line to which respective transistors for applying potentials to the R electrode, the G electrode, the B electrode, and the W electrode are connected may be common to the R electrode, the G electrode, the B electrode, and the W electrode, and a scanning signal line to which respective transistors for applying potentials to the R electrode, the G electrode, and the B electrode are connected may be common to the R electrode, the G electrode, and the B electrode, and may be different from a scanning signal line to which a transistor for applying a potential to the W electrode is connected.

DETAILED DESCRIPTION OF THE INVENTION

Figure 1:
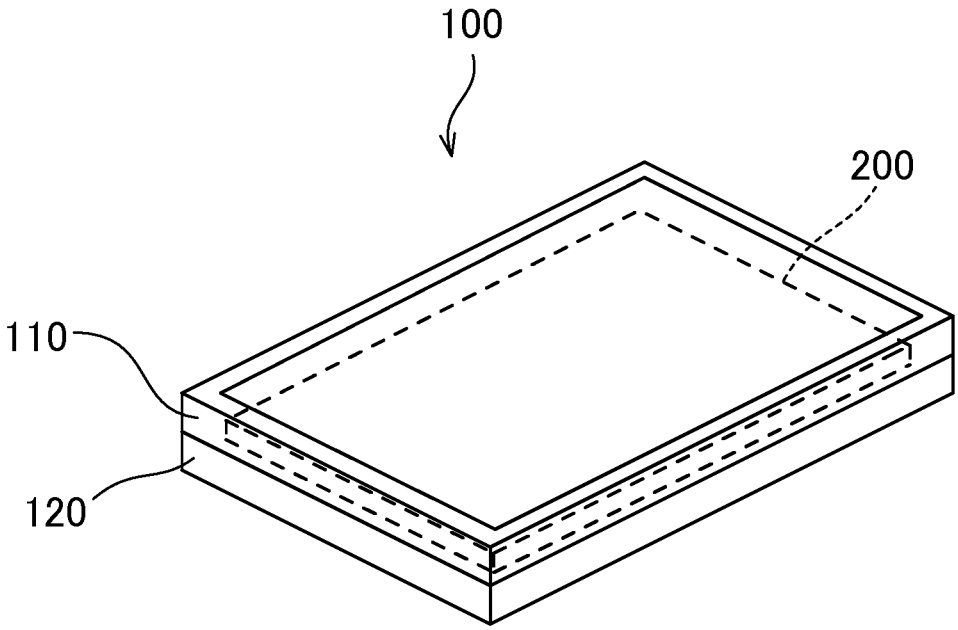
FIG. 1 is a diagram schematically showing an organic EL display device according to a first embodiment of the invention.

Hereinafter, first and second embodiments of the invention will be described with reference to the drawings. In the drawings, the same or equivalent elements are denoted by the same reference numerals and signs, and a redundant description is omitted.

[First Embodiment]

FIG. 1 schematically shows an organic EL display device 100 according to a first embodiment of the invention. As shown in the drawing, the organic EL display device 100 is composed of an organic EL panel 200 fixed between an upper frame 110 and a lower frame 120.

Figure 2:
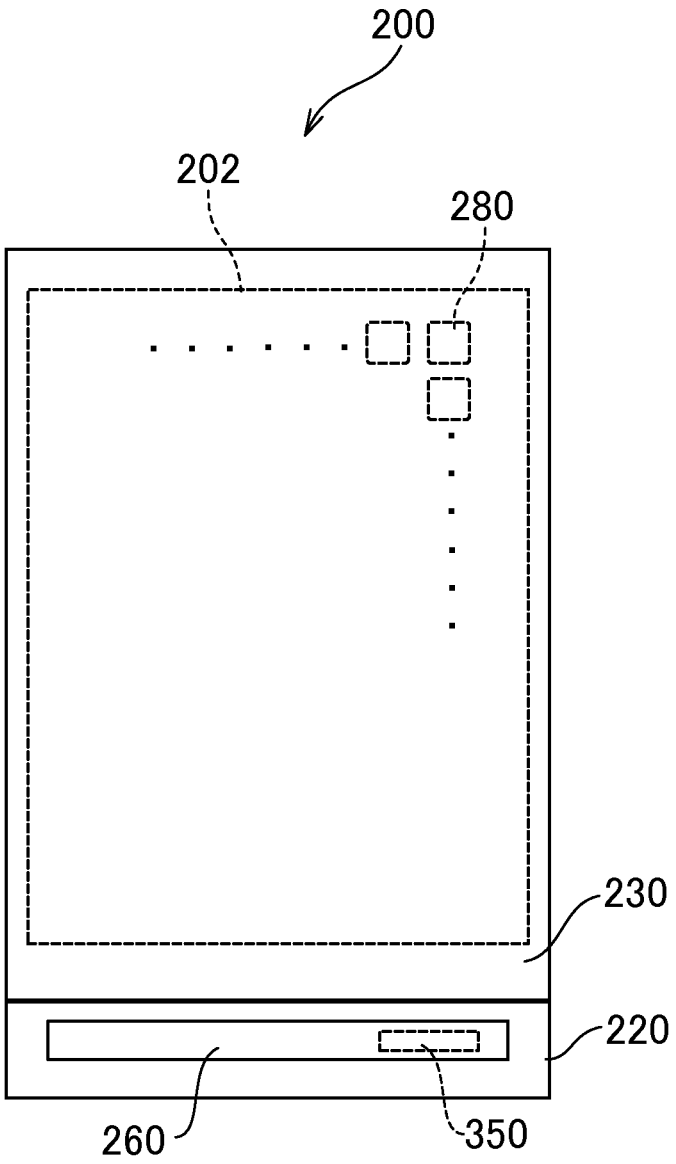
FIG. 2 is a diagram showing the configuration of an organic EL panel in FIG. 1.

FIG. 2 shows the configuration of the organic EL panel 200 in FIG. 1. The organic EL panel 200 includes two substrates, a TFT (Thin Film Transistor) substrate 220 and a sealing substrate 230. A space between the substrates is filled with a transparent resin (not shown). The TFT substrate 220 includes pixels 280 arranged in a matrix in a display region 202. Moreover, the TFT substrate 220 includes a driver IC (Integrated Circuit) 260 as a driver circuit that applies, to a scanning signal line (not shown) of a pixel transistor arranged in each of later-described sub-pixels arranged in the pixel, a potential for providing electrical continuity between the source and drain of the pixel transistor, and applies, to a data signal line of each of the pixel transistors, a voltage corresponding to the gray-scale value of the pixel. The driver IC 260 includes therein a sub-pixel control unit 350 for controlling light emission of each of the later-described sub-pixels.

Figure 3:
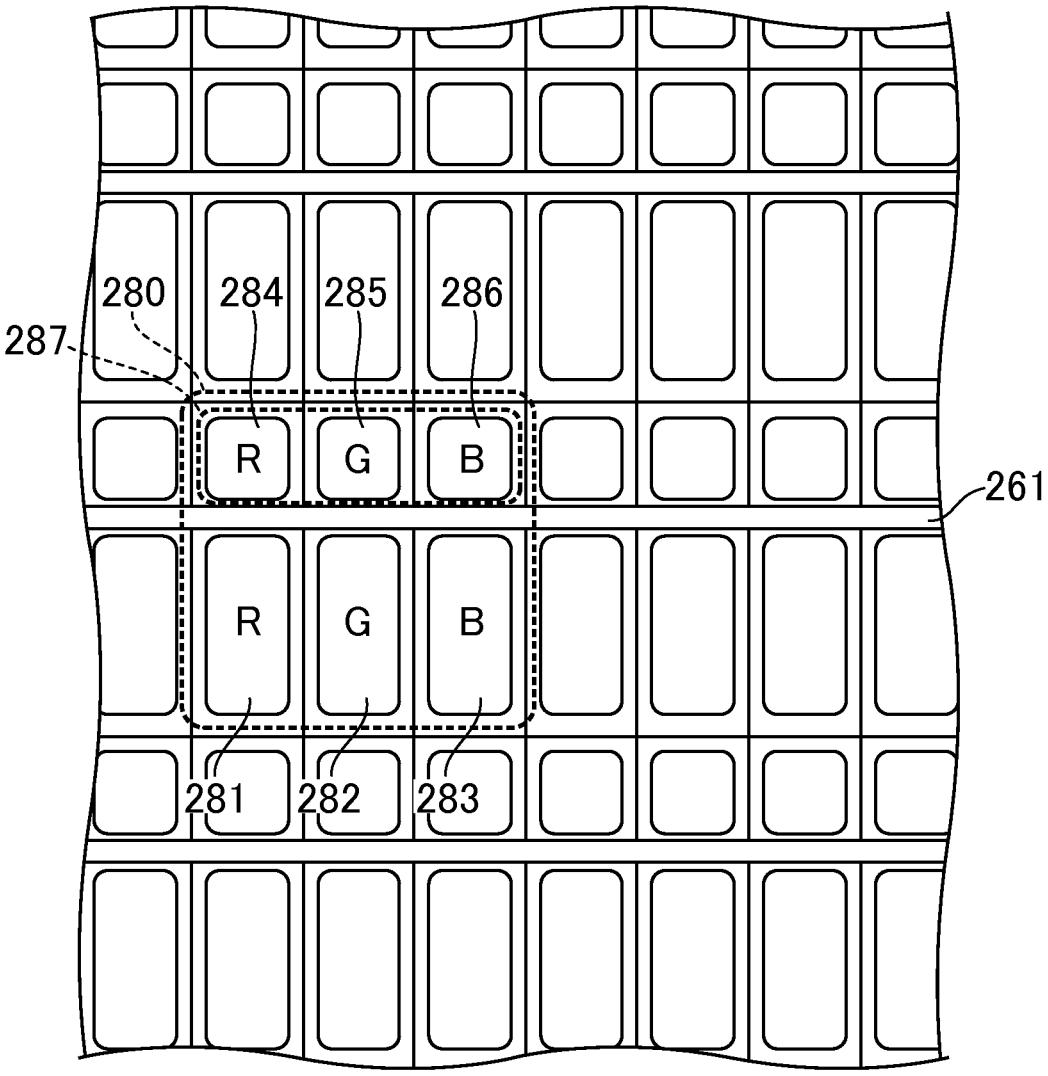
FIG. 3 is a diagram showing pixels arranged in a TFT substrate.

FIG. 3 is a diagram showing the pixels 280 arranged in the TFT substrate 220. As shown in the drawing, the pixel 280 includes a first R (red) sub-pixel 281 and a second R sub-pixel 284 each of which includes a light-emitting portion that emits light in an R wavelength range, a first G (green) sub-pixel 282 and a second G sub-pixel 285 each of which includes a light-emitting portion that emits light in a G wavelength range, and a first B (blue) sub-pixel 283 and a second B sub-pixel 286 each of which includes a light-emitting portion that emits light in a B wavelength range. A scanning signal line 261 is arranged between the first R sub-pixel 281, the first G sub-pixel 282, and the first B sub-pixel 283, and the second R sub-pixel 284, the second G sub-pixel 285, and the second B sub-pixel 286. A light-emitting region of each of the first R sub-pixel 281, the first G sub-pixel 282, and the first B sub-pixel 283 is formed larger in size than a light-emitting region of each of the second R sub-pixel 284, the second G sub-pixel 285, and the second B sub-pixel 286. As will be described later, the second R sub-pixel 284, the second G sub-pixel 285, and the second B sub-pixel 286 are combined together to constitute a W sub-pixel 287.

Figure 4:
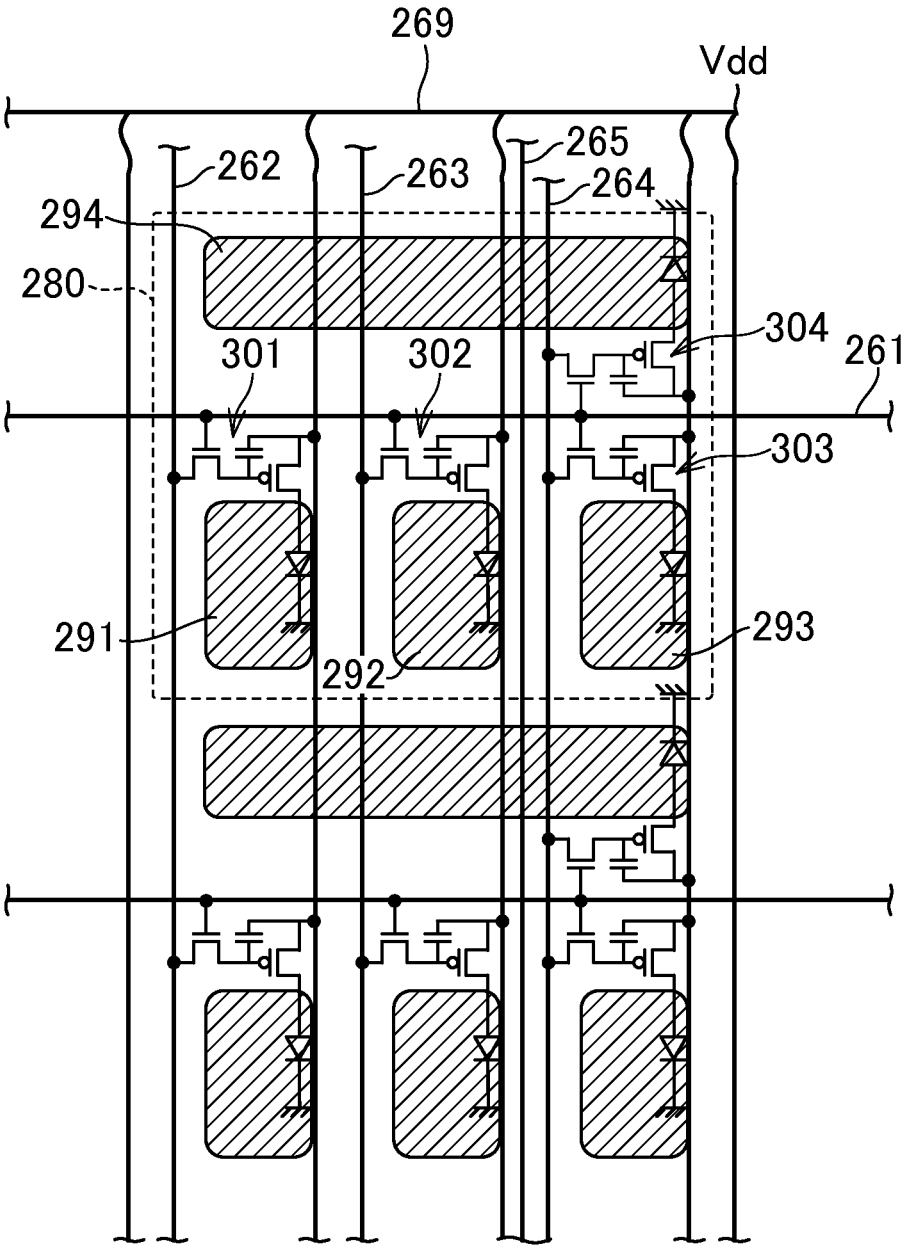
FIG. 4 is a diagram schematically showing circuits arranged in the pixel.

FIG. 4 is a diagram schematically showing circuits arranged in the pixel 280. As shown in the drawing, in the first R sub-pixel 281, an R anode electrode 291 and an R pixel circuit 301 that correspond to the first R sub-pixel 281 are arranged. In the first G sub-pixel 282, a G anode electrode 292 and a G pixel circuit 302 that correspond to the first G sub-pixel 282 are arranged. In the first B sub-pixel 283, a B anode electrode 293 and a B pixel circuit 303 that correspond to the first B sub-pixel 283 are arranged. In the W sub-pixel 287, a W anode electrode 294 and a W pixel circuit 304 that correspond to the W sub-pixel 287 are arranged. Potentials based on gray-scale values are respectively applied to the pixel circuits, and also, an R signal line 262, a G signal line 263, a B signal line 264, and a W signal line 265 that control light emission are wired in the pixel circuits so as to cross the scanning signal line 261. Further, a power line 269 that bears substantial power supply at the time of light emission is also wired so as to cross the scanning signal line 261.

That is, the W sub-pixel 287 is configured such that the respective R, G, and B light-emitting regions of the second R sub-pixel 284, the second G sub-pixel 285, and the second B sub-pixel 286 as constituent elements of the W sub-pixel 287 are controlled by one W anode electrode 294 and one W pixel circuit 304. With this configuration, in the second R sub-pixel 284, the second G sub-pixel 285, and the second B sub-pixel 286 that constitute the W sub-pixel 287, all of the R, G, and B light-emitting regions simultaneously emit lights. The circuit shown in each of the sub-pixels is illustrative only, and the circuit may have any form as long as the circuit performs control so as to flow current based on a gray-scale value into an anode electrode.

Figure 5:
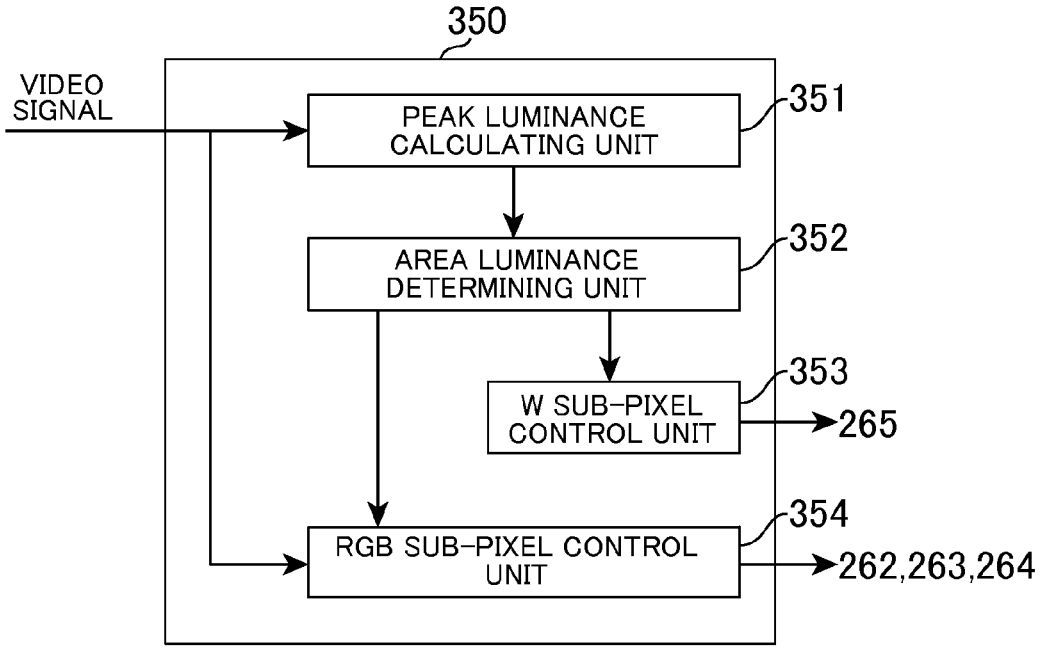
FIG. 5 is a block diagram showing the configuration of a sub-pixel control unit.

FIG. 5 is a block diagram showing the configuration of the sub-pixel control unit 350. As shown in the drawing, the sub-pixel control unit 350 includes a peak luminance calculating unit 351, an area luminance determining unit 352, a W sub-pixel control unit 353, and an RGB sub-pixel control unit 354. The peak luminance calculating unit 351 calculates the peak luminance of a received video signal of one screen and a position on the screen. The area luminance determining unit 352 divides, based on the peak luminance and the position on the screen determined by the peak luminance calculating unit 351, the screen to determine areas, or previously determines areas, and determines, for each of the areas, the luminance of the W sub-pixel 287 included in the area. The W sub-pixel control unit 353 applies, to the corresponding W signal line 265, a voltage corresponding to the luminance determined by the area luminance determining unit 352. The RGB sub-pixel control unit 354 determines, from the video signal and the luminance determined by the area luminance determining unit 352, the luminances of the first R sub-pixel 281, the first G sub-pixel 282, and the first B sub-pixel 283 in each of the pixels 280, and applies voltages corresponding to the luminances to the R signal line 262, the G signal line 263, and the B signal line 264.

Figure 6:
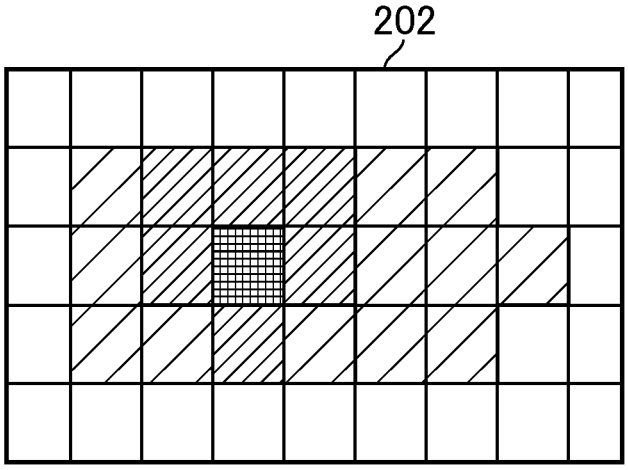
FIG. 6 is a diagram showing an example of an area arrangement for luminance determined by an area luminance determining unit.
Figure 7:
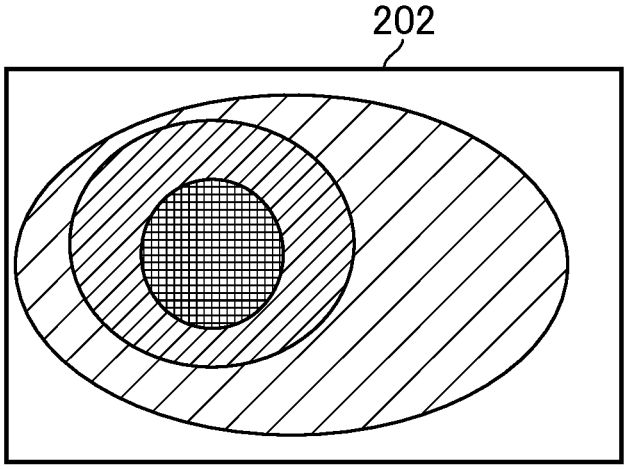
FIG. 7 is a diagram showing an example of an area arrangement for luminance determined by the area luminance determining unit.

The area luminance determining unit 352 may determine the respective luminances of, for example, rectangular areas previously determined as shown in FIG. 6. Alternatively, the area luminance determining unit 352 may determine areas having similar luminance as shown in FIG. 7, and determine the respective luminances of the determined areas. Further, areas may be set in pixel units, and the luminance of the W sub-pixel may be determined in pixel units.

Moreover, the W sub-pixel control unit 353 may set a light emission time period of the W sub-pixel to be shorter than that of the R, G, and B sub-pixels, for example, the W sub-pixel control unit 353 may cause the W sub-pixel to emit light for ½ or ⅓ the time period of the R, G, and B sub-pixels with luminance being doubled or tripled, respectively. When such control is employed, it is especially possible to eliminate motion blur occurring in so-called hold-type display devices.

In the embodiment as has been described above, since a region to emit light in a W wavelength range is provided in the organic EL display device, a color reproduction range can be expanded, and also, an improvement in color purity can be achieved.

Moreover, since the region to emit light in the W wavelength range is adjacent to the R, G, and B sub-pixels, more natural luminance can be expressed in each of the pixels. Moreover, since the scanning signal line 261 is commonly used, layout can be simplified, and the aperture ratio can be improved. Moreover, with the use of display that the W sub-pixel bears luminance, motion blur can be eliminated.

[Second Embodiment]

Figure 8:
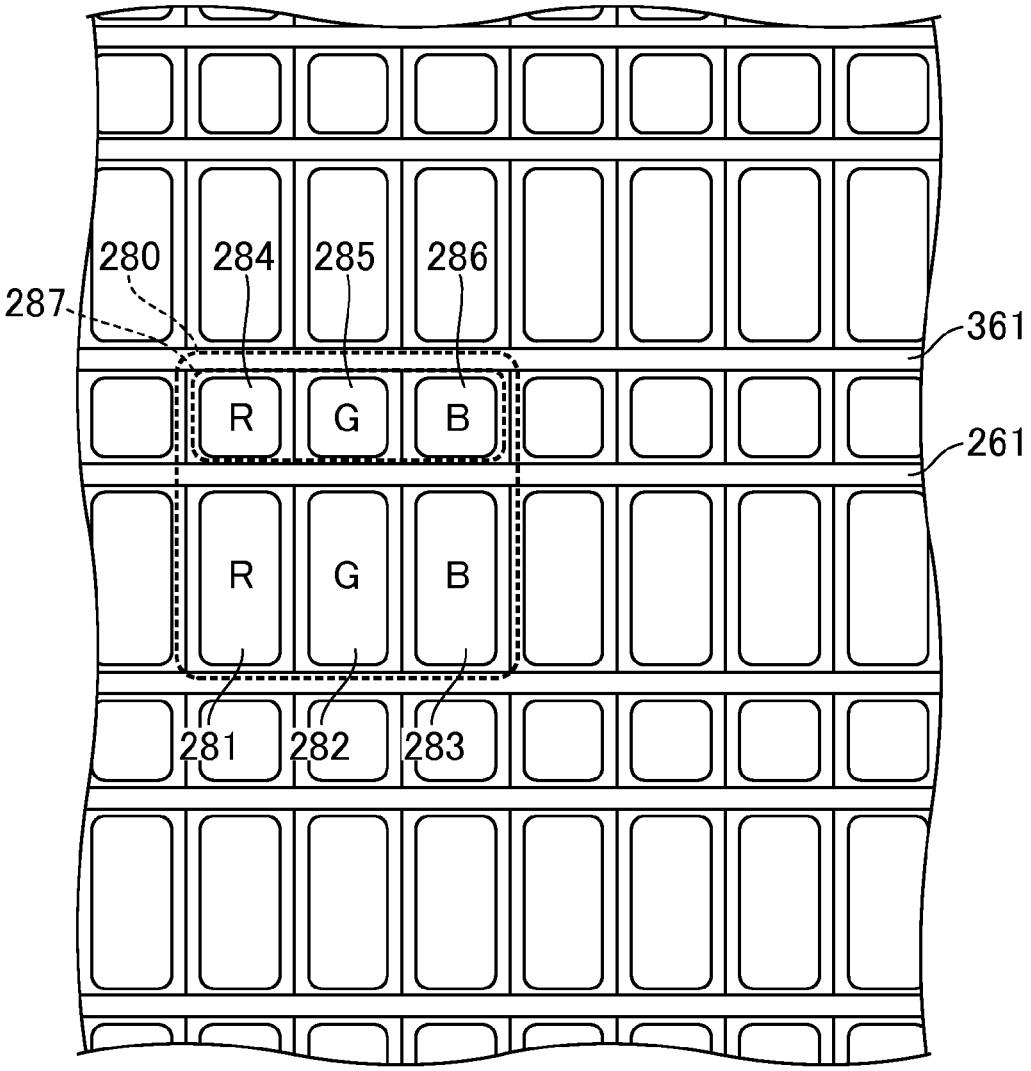
FIG. 8 is a diagram showing pixels arranged in a TFT substrate according to a second embodiment of the invention.

An organic EL display device according to a second embodiment will be described. The entire configuration of the organic EL display device and the configuration of an organic EL panel according to the second embodiment are similar to those in FIGS. 1 and 2 of the first embodiment, and therefore, a description is omitted. FIG. 8 is an enlarged view showing the pixels 280 arranged in the TFT substrate 220 according to the second embodiment of the invention. FIG. 8 differs from FIG. 3 of the first embodiment in that a W scanning signal line 361 is included in addition to the scanning signal line 261. In other respects, FIG. 8 is similar to FIG. 3, and therefore, a description is omitted.

Figure 9:
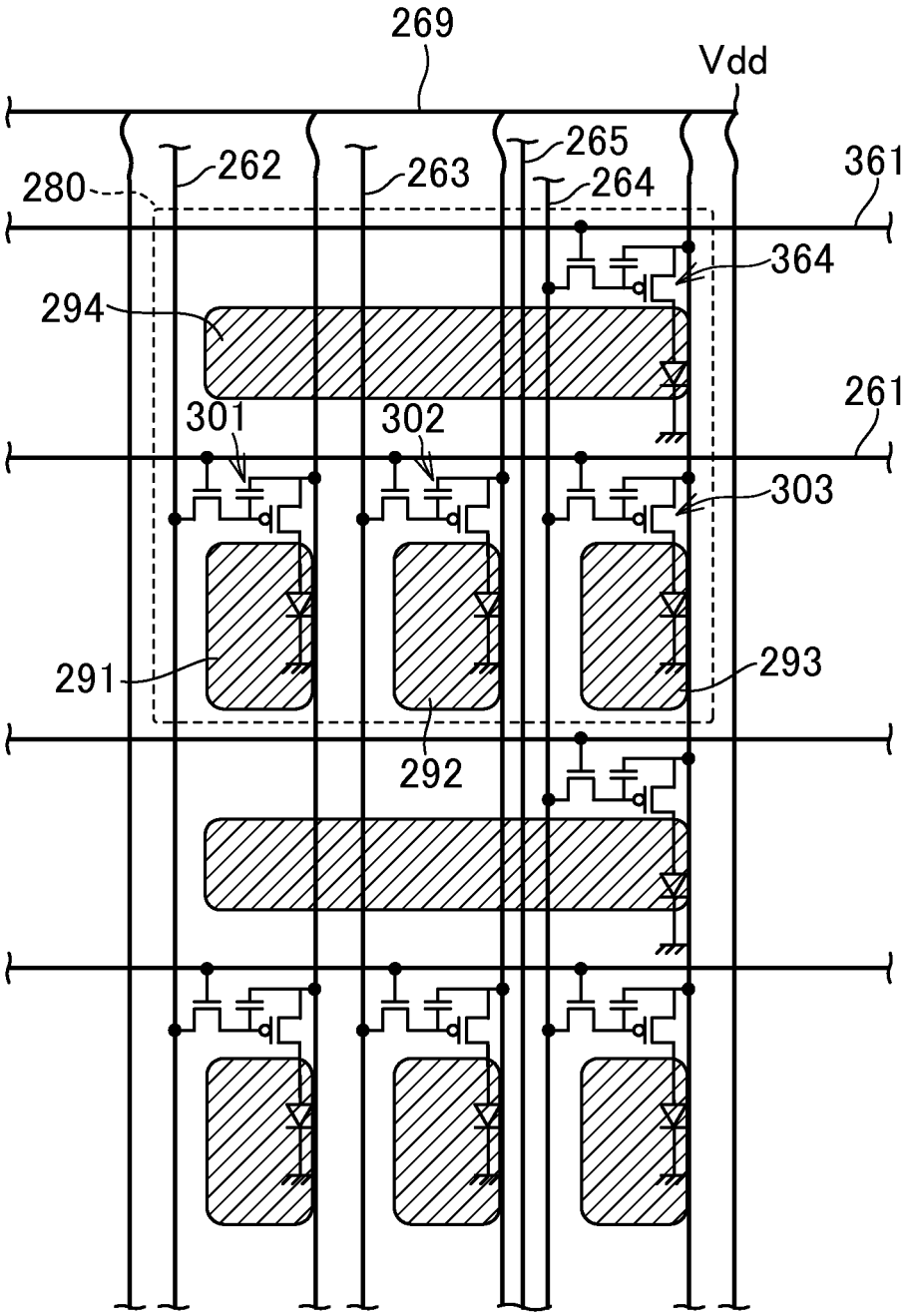
FIG. 9 is a diagram schematically showing circuits arranged in the pixel of the TFT substrate according to the second embodiment.

FIG. 9 is a diagram schematically showing circuits arranged in the pixel 280 of the TFT substrate 220 according to the second embodiment. As shown in the drawing, the embodiment including the W scanning signal line 361 has a configuration including, not the W pixel circuit 304, but a W pixel circuit 364 connected to the W scanning signal line 361. By providing the independent scanning signal line for the independent W sub-pixel 287 as described above, the luminance of the W sub-pixel 287 can be controlled independently of the timing of updating a screen, so that lower power consumption can be achieved.

Even when the configuration according to the second embodiment is employed, since the region to emit light in the W wavelength range is provided similarly to the first embodiment, a color reproduction range can be expanded, and also, an improvement in color purity can be achieved. Moreover, with the use of display that the W sub-pixel bears luminance, motion blur can be eliminated.

In the embodiments described above, a stripe arrangement is employed in which the regions to emit lights of respective colors of R, G, and B are arranged such that the same color is formed in one direction. However, the invention can be applied also to a dot arrangement in which different colors are arranged in each column. Especially, a so-called delta arrangement may be used.

Moreover, in the embodiments described above, it is assumed that emission of light in the W wavelength range is performed by emitting lights of respective colors of R, G, and B. However, a pixel maybe configured to bear another wavelength range such as a pixel to emit light in, for example, a Y (yellow) wavelength range.

For deposition of light-emitting layers in the embodiments described above, an ink jet method can be used in addition to a method of separately depositing R, G, and B light-emitting layers. When the ink jet is used, material cost can be lowered by using polymeric materials, and manufacturing facility cost can be suppressed.

Moreover, in the embodiments described above, the driver circuit is incorporated into the driver IC. However, a portion or the whole of the driver circuit may be directly formed on the TFT substrate.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A light-emitting element display device comprising a light-emitting element display panel that displays an image by light emission of light-emitting regions of a plurality of sub-pixels arranged in each of pixels in a display region, controlled by a driver circuit, wherein the light-emitting element display device includes light-emitting portions that respectively emit lights of R (red), G (green), and B (blue), each of the pixels includes a first R sub-pixel and a second R sub-pixel each of which emits light in a red wavelength range, a first G sub-pixel and a second G sub-pixel each of which emits light in a green wavelength range, and a first B sub-pixel and a second B sub-pixel each of which emits light in a blue wavelength range, the first R sub-pixel, the first G sub-pixel, and the first B sub-pixel respectively include an R electrode, a G electrode, and a B electrode that control light emission independently of one another in response to the application of potentials, the second R sub-pixel, the second G sub-pixel, and the second B sub-pixel include a W (white) electrode as a common electrode that causes the second R sub-pixel, the second G sub-pixel, and the second B sub-pixel to simultaneously emit lights in response to the application of a potential, the driver circuit includes a sub-pixel control unit that acquires a video signal to calculate a peak luminance in a screen based on the video signal and controls the plurality of sub-pixels based on the peak luminance, the sub-pixel control unit includes a peak luminance calculating unit that calculates the peak luminance, an area luminance determining unit that determines, based on the peak luminance calculated by the peak luminance calculating unit, the luminance of a W sub-pixel including the W electrode arranged in the pixel in each of areas obtained by dividing the display region into a plurality of regions, and a W sub-pixel control unit that applies, using the luminance of the W sub-pixel, a potential to the W electrode arranged in the pixel in each of the areas, and the area luminance determining unit further determines the division of areas based on the peak luminance.

2. The light-emitting element display device according to claim 1, wherein the area luminance determining unit further determines a light emission time period as a time period in which the potential is applied.

3. The light-emitting element display device according to claim 1, wherein the sub-pixel control unit further includes an RGB sub-pixel control unit that determines, based on determination of the area luminance determining unit, the luminances of the first R sub-pixel, the first G sub-pixel, and the first B sub-pixel and applies, based on the respective determined luminances, potentials to the R electrode, the G electrode, and the B electrode.

4. The light-emitting element display device according to claim 1, wherein a scanning signal line to which respective transistors for applying potentials to the R electrode, the G electrode, the B electrode, and the W electrode are connected is common to the R electrode, the G electrode, the B electrode, and the W electrode.

5. The light-emitting element display device according to claim 1, wherein a scanning signal line to which respective transistors for applying potentials to the R electrode, the G electrode, and the B electrode are connected is common to the R electrode, the G electrode, and the B electrode, and is different from a scanning signal line to which a transistor for applying a potential to the W electrode is connected.

6. The light-emitting element display device according to claim 1, wherein the first R sub-pixel and the second R sub-pixel are aligned in a first direction, the first G sub-pixel and the second G sub-pixel are aligned in the first direction, the first B sub-pixel and the second B sub-pixel are aligned in the first direction, the first R sub-pixel, the first G sub-pixel and the first B sub-pixel are aligned in a second direction different from the first direction, and the second R sub-pixel, the second G sub-pixel and the second B sub-pixel are aligned in the second direction.

7. The light-emitting element display device according to claim 1, wherein the first R sub-pixel is larger than the second R sub-pixel, the first G sub-pixel is larger than the second G sub-pixel, and the first B sub-pixel is larger than the second B sub-pixel.

* * * * *